US012458864B1

(12) United States Patent
Du

(10) Patent No.: US 12,458,864 B1
(45) Date of Patent: Nov. 4, 2025

(54) HANDLEBAR COVER FOR SPORTS EQUIPMENT

(71) Applicant: Yulan Du, Dongguan (CN)

(72) Inventor: Yulan Du, Dongguan (CN)

( * ) Notice: Subject to any disclaimer, the term of this patent is extended or adjusted under 35 U.S.C. 154(b) by 0 days.

(21) Appl. No.: 18/900,316

(22) Filed: Sep. 27, 2024

(51) Int. Cl.
*A63B 71/00* (2006.01)
*A63B 21/00* (2006.01)

(52) U.S. Cl.
CPC ..... *A63B 71/0036* (2013.01); *A63B 21/4035* (2015.10)

(58) Field of Classification Search
CPC ..... A63B 71/0036; A63B 21/4035; B62K 21/125; B62K 21/14; B62K 21/16
See application file for complete search history.

(56) References Cited

U.S. PATENT DOCUMENTS 3,765,375 A * 10/1973 Young
4,625,963 A * 12/1986 Lancellotti ..... A63B 23/03533 482/130
4,869,491 A * 9/1989 Nolan ..... A63B 23/14 482/45
4,973,043 A * 11/1990 Nolan ..... A63B 23/14 482/106
5,152,731 A * 10/1992 Troutman ..... A63B 21/0724 482/106
5,433,288 A * 7/1995 James ..... A62C 33/04 224/250
6,224,518 B1 * 5/2001 Weiss ..... A63B 21/078 482/106
7,641,604 B2 * 1/2010 Blount
7,736,284 B1 * 6/2010 Andrews ..... A63B 21/072 482/92
7,935,036 B2 * 5/2011 Haynes ..... A63B 21/4025 482/121
8,602,278 B2 * 12/2013 Sweigart
9,795,856 B2 * 10/2017 Seilus et al.
10,398,923 B2 * 9/2019 Hur ..... A63B 21/0552
10,486,048 B2 * 11/2019 Gravel ..... A63B 71/0054
10,945,565 B2 * 3/2021 Kasten ..... A63B 71/00
11,071,885 B2 * 7/2021 Hadley ..... A61H 15/0092
11,266,870 B2 * 3/2022 Leadbetter ..... A63B 21/0724
D956,892 S * 7/2022 d'Anconia ..... D21/693
11,497,953 B1 * 11/2022 Naparstek ..... A63B 21/0552
11,628,329 B2 * 4/2023 Heisner ..... B62K 21/125 482/57

(Continued)

*Primary Examiner* — Jason W San
*Assistant Examiner* — Matthew J Sullivan
(74) *Attorney, Agent, or Firm* — Che-Yang Chen; Law Office of Michael Chen

(57) ABSTRACT

A handlebar includes a left handlebar cover and a right handlebar cover, a connection component is provided between the left handlebar cover and the right handlebar cover, the left elastic rings are fixedly connected to the left and right ends of the left handlebar cover, the right elastic rings are fixedly connected to the left and right ends of the right handlebar cover, the friction surfaces are provided in the left handlebar cover and right handlebar cover, the left elastic ring and the right elastic ring are respectively fastened to the handle, this can restrain the handlebar and prevent the left handlebar cover and right handlebar cover from loosening. At the same time, the fastening ring can also be fastened to the handlebar to make the left and right handlebar covers more firm.

6 Claims, 9 Drawing Sheets

(56) References Cited

U.S. PATENT DOCUMENTS 11,633,658 B2 * 4/2023 Raber ..... A63B 21/0724 482/106
11,730,998 B2 * 8/2023 Cernasov ..... A63B 21/0726 482/8
11,752,383 B2 * 9/2023 Weck ..... A63B 71/0622 482/82
11,850,495 B2 * 12/2023 Nock ..... A63B 71/0036
11,911,649 B2 * 2/2024 Hull ..... A63B 21/4035
12,083,377 B2 * 9/2024 DeAngelo
12,090,384 B2 * 9/2024 Lewis ..... A63B 71/0045
2004/0007086 A1 * 1/2004 Cummings
2004/0007087 A1 * 1/2004 Cummings
2008/0034915 A1 2/2008 Bigolin
2009/0093349 A1 * 4/2009 Cooper ..... A63B 21/0004 482/106
2009/0197742 A1 * 8/2009 Hartman ..... A63B 21/026 482/92
2009/0264267 A1 * 10/2009 Ballif ..... A63B 21/0004 482/139
2009/0314126 A1 * 12/2009 Longnecker
2013/0029810 A1 * 1/2013 Olivencia ..... A63B 71/1225 482/93
2014/0123804 A1 * 5/2014 Robins et al.
2014/0231479 A1 * 8/2014 Van Zanten
2015/0041603 A1 * 2/2015 Kinder
2015/0197306 A1 * 7/2015 Denby ..... B62K 21/26 74/551.9
2016/0145786 A1 * 5/2016 Kinder
2016/0311496 A1 * 10/2016 Atterbury ..... B62K 21/125
2019/0059568 A1 * 2/2019 Orlando ..... A46B 5/0041
2019/0126086 A1 * 5/2019 Tousant ..... A63B 5/20
2019/0290986 A1 * 9/2019 Cobb ..... A63B 21/00043
2020/0069994 A1 * 3/2020 Plumbar ..... A63B 21/0442
2020/0069995 A1 * 3/2020 Zelazny ..... A63B 21/4035
2020/0276467 A1 * 9/2020 O'Herron ..... A63B 21/0428
2020/0398105 A1 * 12/2020 Coulter ..... A63B 23/1218
2021/0052938 A1 * 2/2021 Rabiner ..... A63B 21/4035
2021/0154546 A1 * 5/2021 Sliepka ..... A63B 60/08
2024/0001216 A1 * 1/2024 Yao ..... A63B 71/14
2024/0033560 A1 * 2/2024 Knuckles ..... A63B 21/4035

* cited by examiner

HANDLEBAR COVER FOR SPORTS EQUIPMENT

FIELD OF THE INVENTION

The invention relates to the technical field of sports equipment, and in particular to a handlebar cover for sports equipment.

BACKGROUND OF THE INVENTION

Nowadays, with the improvement of people's living standards, leisure activities such as sports and fitness are becoming more and more enriched. With the national call for national fitness, more and more people are participating in professional sports competitions and leisure sports. Spinning bicycles are a commonly used fitness tool in people's lives, generally include a bicycle frame, a flywheel that is rotationally connected to the bicycle frame, and a pedal component that is connected to the flywheel transmission. When people step on the pedal component, the pedal component can drive the flywheel to rotate to achieve the purpose of simulating riding, in order to achieve the purpose of physical exercise.

For example, Chinese patent (Patent number: CN207532688U) discloses a spinning bicycle, which includes a bicycle frame and a seat cushion, the aforementioned bicycle frame includes a bottom frame and a vertical pole arranged on the bottom frame, the bottom of the vertical pole is fixedly connected with the front end of the bottom frame. It is characterized in that: the top of the vertical pole is provided with a cushion cantilever rod, the cushion cantilever rod extends backward from the top of the vertical pole, and the seat cushion is arranged at the rear end of the cushion cantilever rod.

The above-mentioned patent provides a cantilever cushion spinning bicycle, so that there is no support under the seat cushion with free space. The cantilever structure not only makes the seat cushion have a certain degree of flexibility, further makes the movement more comfortable than ordinary spinning bicycles during exercise, but also meet the appearance design needs of spinning bikes.

However, there is no protective apparatus on the handlebar in the above-mentioned patents. Firstly, when the fitness personnel continue to exercise, sweat will occur between the handlebar and hands and affect the effect of exercise. Secondly, the handlebar of existing spinning bicycles are usually covered with hard rubber, which may cause pain in the hand palm and reduce comfort level when held for long periods of time. Finally, rubber handlebar cover may easily fall off the handlebar and become lost during long-term exercise.

Therefore, the present invention provides a handlebar cover for sports equipment to solve the above problems.

SUMMARY OF THE DISCLOSURE

In order to solve the above problems, the present invention provides a handlebar cover for sports equipment, which effectively solves the problem of existing rubber handlebar cover: firstly, the rubber handlebar cover of prior arts has a relatively hard grip feelings and reduces the comfort level; secondly, it is easy to fall off from the handlebar and easy to lose; finally, it is not absorbing sweat.

In order to achieve the above objects, the present invention provides the following technical solutions:

A handlebar cover for sports equipment, including a left handlebar cover and a right handlebar cover, the connection component is provided between the left handlebar cover and the right handlebar cover, the left elastic rings are fixedly connected to the left and right ends of the left handlebar cover, the right elastic rings are fixedly connected on the left and right ends of the right handlebar cover. The connection component includes a strap loop, which is fixedly connected to the left end of the right handlebar cover, and the right end of the left handlebar cover is fixedly connected with a fastening belt.

Preferably, the left and right ends of the left handlebar cover and the right handlebar cover are evenly connected with a plurality of fixing rings, and the plurality of fixing rings arranged on the same side are respectively provided with fastening rings.

Preferably, a plurality of friction strips are provided on the outer end surfaces of the left handlebar cover and the right handlebar cover respectively.

Preferably, the connection component includes a strap loop, the strap loop is fixedly connected to the left end of the right handlebar cover, and the right end of the left handlebar cover is fixedly connected to a fastening belt.

Preferably, the Velcro is provided on the right end of the fastening belt.

Preferably, the left handlebar cover and the right handlebar cover are made of cotton material.

Preferably, the friction surfaces are respectively provided inside the left handlebar cover and the right handlebar cover.

A handlebar cover for sports equipment, the left end of the right handlebar cover and the right end of the left handlebar cover are respectively fixedly connected with strap loops, and the two strap loops are connected by a fastening belt.

A handlebar cover for sports equipment, a fastening belt is fixedly connected to the left end of the right handle cover and the right end of the left handle cover.

The beneficial effects of the present invention are:

1. The left elastic ring and the right elastic ring are fastened to the handlebar respectively, which can restrain the handlebar and prevent the left handlebar cover and right handlebar cover from loosening. At the same time, the fastening ring can also be fastened to the handlebar to make the left handlebar cover and right handlebar cover more firm.
2. The arrangement of Velcro prevents the left handlebar cover and right handlebar cover from being lost. At the same time, the friction surface can increase the friction with the handlebar and improve the use effect.
3. The arrangement of the friction strip can increase the friction with the palm, and can also have a massage function on the palm to improve the comfort level of the user's hands.
4. The left handlebar cover and the right handlebar cover are made of cotton material, which is capable of evaporating sweat quickly with good hygroscopicity and breathability, and the cotton material is relatively soft, further improving the comfortness of hand feelings.
5. The right handlebar cover and the left handlebar cover are provided with strap loops and connected by Velcro, which makes them more convenient to use and prevents them from being lost.
6. The fastening belt is fixedly connected to the left end of the right handle cover and the right end of the left handle cover, which can prevent them from being lost.

DETAILED DESCRIPTION OF THE PREFERRED EMBODIMENTS

Figure 1:
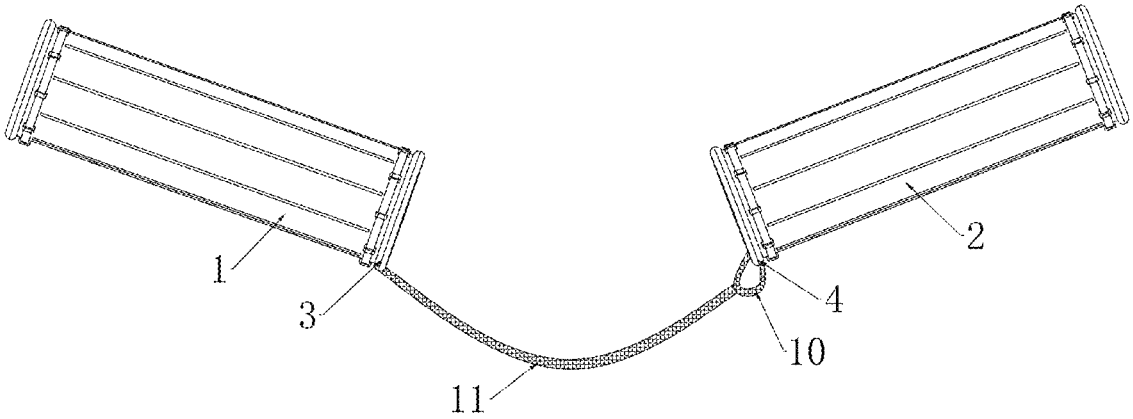
FIG. 1 is a first perspective view of the present invention.
Figure 2:
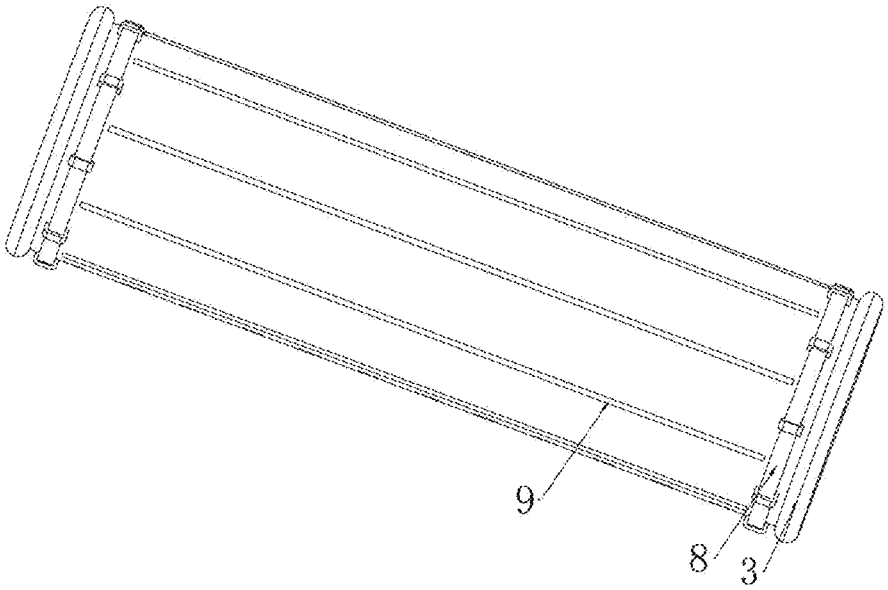
FIG. 2 is a schematic view of the position of the fastening ring.
Figure 3:
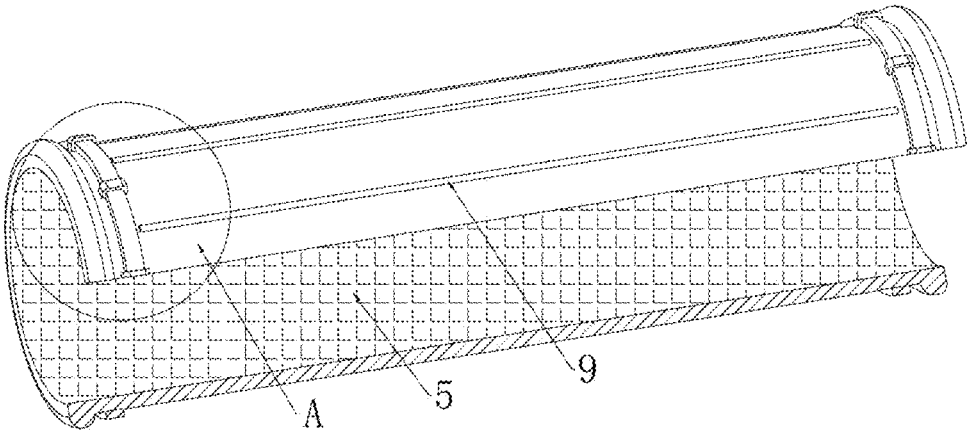
FIG. 3 is a schematic structural view of the friction surface.

Other features, objects and advantages of the present invention will be more clearly and completely by the detailed description of the non-limiting embodiments with reference to the attached drawings (FIG. 1 to FIG. 9). Obviously, the described embodiments are only part of the embodiments of the present invention, but not all of in them. Based on the embodiments of the present invention, all other embodiments obtained by ordinary technicians in the field without creative labor are within the scope of the present invention.

As shown in FIGS. 1 to 9, a handlebar cover for sports equipment includes a left handlebar cover 1 and a right handlebar cover 2, the left handlebar cover 1 and the right handlebar cover 2 are of the same specification, both the left handlebar cover 1 and the right handlebar cover 2 are provided in left and right through structure. The connection component is provided between the left handlebar cover 1 and the right handlebar cover 2, the arrangement of the connection component can connect the left handlebar cover 1 and the right handlebar cover 2 together to prevent loss. The left elastic rings 3 are fixedly connected on left and right outer ends of the left handlebar cover 1, the right elastic rings 4 are fixedly connected on the left and right outer ends of the right handlebar cover 2, the left elastic ring 3 and the right elastic ring 4 are of the same specifications with certain elasticity, which can be made of existing rubber bands. The inner surfaces of the left handlebar cover 1 and the right handlebar cover 2 are evenly provided with friction surfaces 5 to increase the friction with the handlebars.

As shown in 4, the left and right outer end surfaces of the left handlebar cover 1 and the right handlebar cover 2 are evenly connected with a plurality of fixing rings 7, each of the fixing rings 7 is provided inside the left elastic ring 3 and the right elastic ring 4, and each fixing ring 7 is fixedly connected to the outer circumferential surface of the left handlebar cover 1 and the right handlebar cover 2. A plurality of fixing rings 7 arranged on the same side are respectively inserted with fastening rings 8, each fastening ring 8 has certain elasticity and can be chosen as existing rubber bands.

Figure 4:
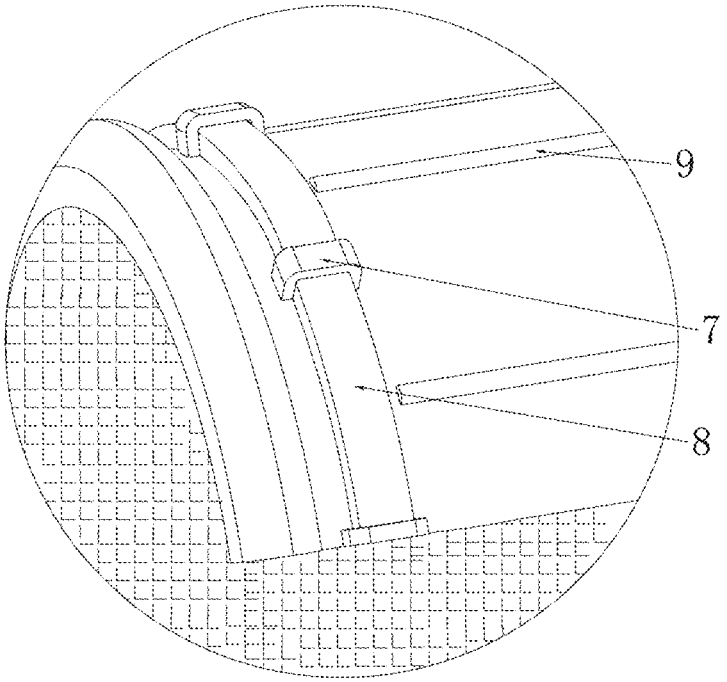
FIG. 4 is an enlarged schematic view of position A in FIG. 3.
Figure 5:
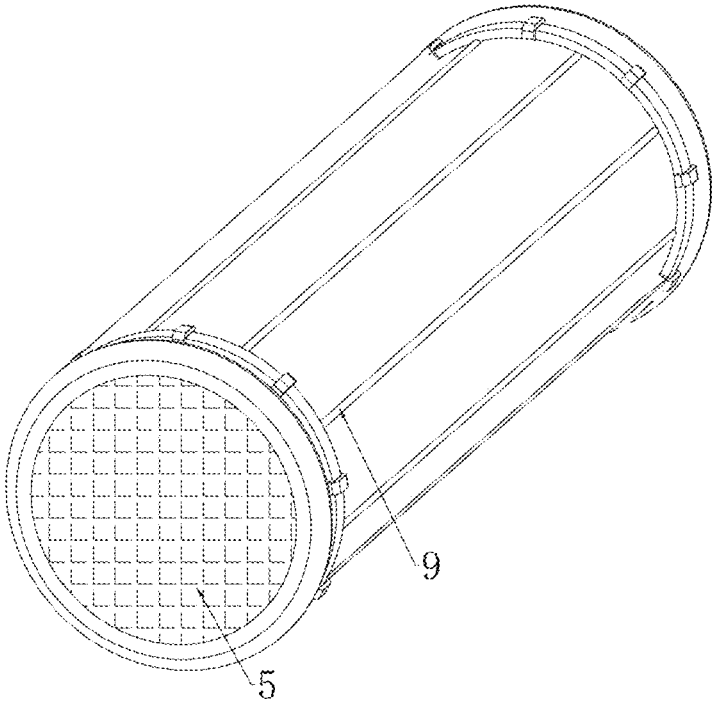
FIG. 5 is a schematic view of the position of the friction strip.
Figure 6:
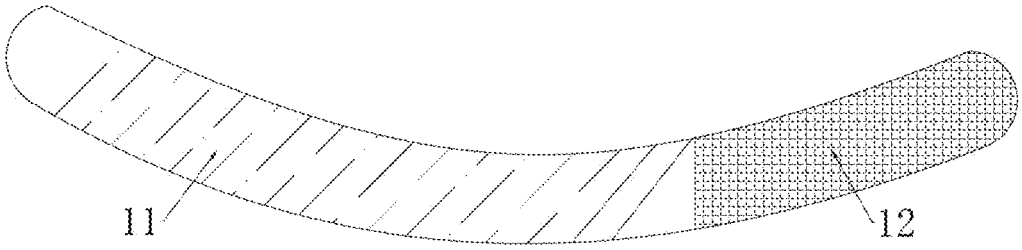
FIG. 6 is a schematic view of the position of the Velcro.

As shown in FIG. 4, a plurality of friction strips 9 are uniformly connected to the outer end surfaces of the left handlebar cover 1 and the right handlebar cover 2, each friction strip 9 is fixedly connected to the left handlebar cover 1 and the right handlebar cover 2. The friction strip 9 is made of soft material, which can increase the friction with the hand, and can also have a massage function on the palm to reduce pain.

As shown in FIG. 1, the connection component includes a strap loop 10, the strap loop 10 is fixedly connected to the left end of the right handlebar cover 2, the right end of the left handlebar cover 1 is fixedly connected to a fastening belt 11, the right end of the fastening belt 11 is fixedly connected with a velcro 12. The left handlebar cover 1 and the right handlebar cover 2 are made of cotton material, they can also be chosen as cotton fabrics, linen fabrics, and ice silk fabrics, which can makes sweat be evaporated quickly with good hygroscopicity and breathability.

Figure 7:
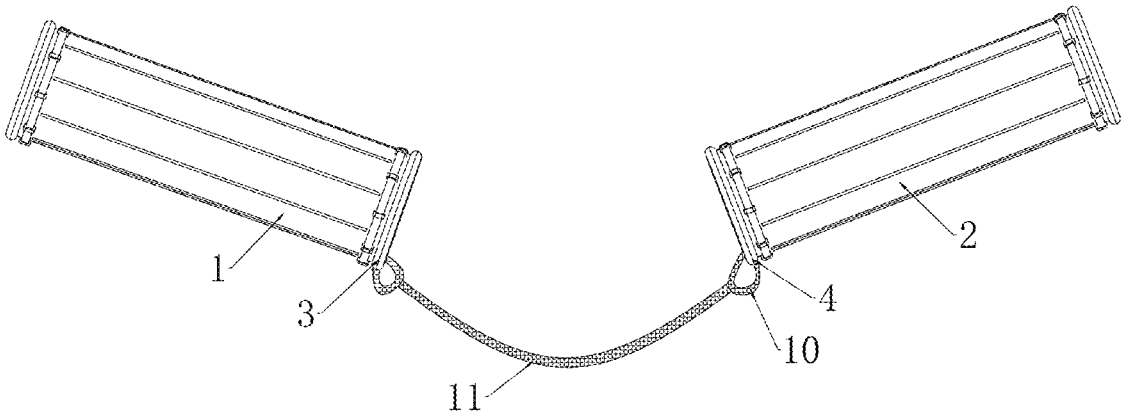
FIG. 7 is a second perspective view of the present invention.
Figure 8:
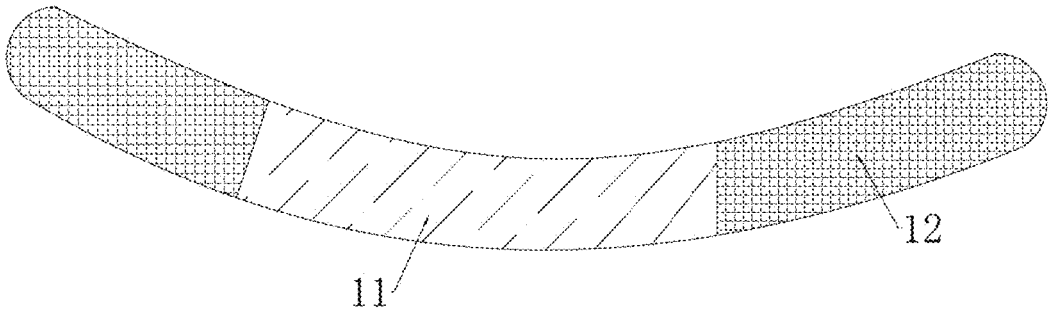
FIG. 8 is a schematic view of the fastening belt.

As shown in FIGS. 7 and 8, a handlebar cover for sports equipment, the left end of the right handlebar cover 2 is fixedly connected with a strap loop 10 and the right end of the left handlebar cover 1 is fixedly connected with a strap loop 10, the two strap loops 10 are connected by fastening belts 11, the left and right ends of the fastening belts 11 are respectively fixed with the velcro 12 or other suitable connection components, such as buckles, snap buttons, etc., buckles and snap buttons are belong to existing technology and will not be described in detail here. The left handlebar cover 1 and the right handlebar cover 2 are made of cotton material, they can also be chosen as cotton fabrics, linen fabrics, and ice silk fabrics, which can makes sweat be evaporated quickly with good hygroscopicity and breathability.

The users can insert the left end of the fastening belt 11 through the left fastening ring 8 and pasted by the left velcro 12, then insert the right end of the fastening belt 11 through the right fastening ring 8 and pasted by the right velcro 12, further the left handlebar cover 1 and the right handlebar cover 2 can be prevented from being lost and can also be quickly removed to save a certain amount of time.

Figure 9:
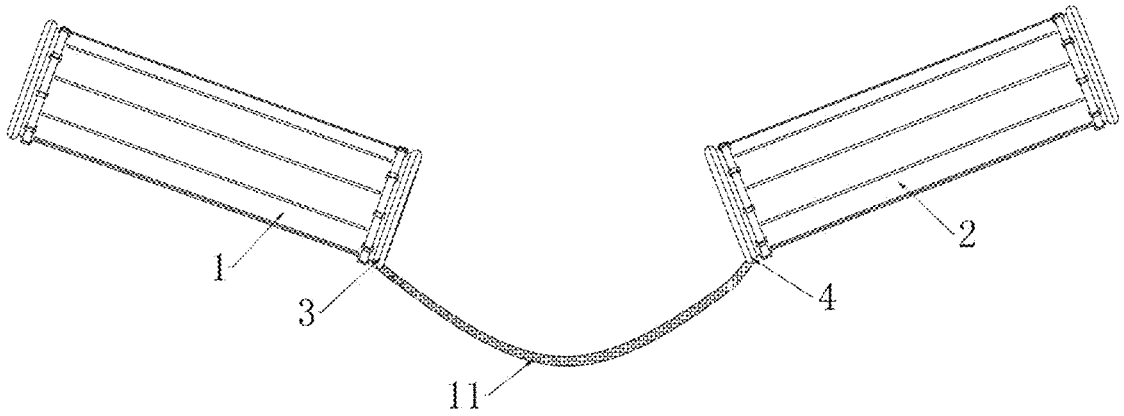
FIG. 9 is a third perspective view of the present invention.

As shown in FIG. 9, a handle cover for sports equipment, a fastening belt 11 is fixedly connected to the left end of the right handle cover 2 and the right end of the left handle cover 1. The left handle cover 1 and the right handle cover 2 are made of cotton material, and cotton fabric, linen fabric, ice silk fabric etc. can also be selected, which has characteristics of good hygroscopicity and breathability, and makes sweat be evaporated quickly.

The principle of the present invention is:

The users can open out the left handlebar cover 1 and the right handlebar cover 2 and sleeve them on the handlebar of the spinning bicycle respectively. At this time, the left elastic ring 3 and the right elastic ring 4 are fastened to the handlebar respectively, which can restrain the handlebar and prevents the left handlebar cover 1 and the right handlebar cover 2 from being separated from the handlebar, and at the same time, the fastening ring 8 can also be fastened to the handlebar, making the left handlebar cover 1 and the right handlebar cover 2 more firm;

Then, the fastening belt 11 is passed through the strap loop 10, and then sticked and fixed by the velcro 12, which can prevent the left handlebar cover 1 and the right handlebar cover 2 from being lost. The friction surface 5 can increase the friction with the handlebar, avoid the left handlebar cover 1 and the right handlebar cover 2 from rotating on the handlebar during use, which will affect the use effect.

When the hands are held on the left handlebar cover 1 and the right handlebar cover 2 for exercise, the friction strips 9 can increase the friction with the palms, and can also have a massage function on the palms to improve the comfort level of the personnel's hands. In addition, the left handlebar cover 1 and the right handlebar cover 2 is made of cotton material with good hygroscopicity and breathability, which can makes sweat be evaporated quickly, and the cotton material is relatively soft, further improving the comfort level of hand.

In the present invention, the use of orientation words such as "inside", "outside" are only for the convenience of description, rather than indicating or implying the specific orientation, therefore it should not be construed as being limited to the description of the following embodiments. In addition, it should be noted that the terms "first", "second" and the like in the description and claims of the present invention and the above drawings are used to distinguish similar objects, which are not necessarily used to describe the specific order or sequence. It is to be understood that the data so used are interchangeable under appropriate circumstances in order to describe the embodiments of the invention herein.

Unless otherwise stated, it should be noted that the terms "provided" and "connected" should be understood broadly. For example, "connected" could be fixed connection, detachable connection, integral connection, mechanical connection, electrical connection, direct connection, indirect connection through the intermediate structure, or internal connection between two elements. For those of ordinary skill in this field, the specific meanings of the above terms in the present invention can be understood in specific situations.

Hereinafter, embodiments of the present invention has been described in detail with reference to the accompanying drawings. While the description above refers to the particular embodiments of the present invention, it will be understood that many modifications may be made without departing from the spirit thereof. Any equivalent replacement or modification would fall within the protection scope of the present invention.

What is claimed is:

1. A handlebar cover for sports equipment, comprising a left handlebar cover (1) and a right handlebar cover (2), a connection component is provided between the left handlebar cover (1) and the right handlebar cover (2), a left elastic ring (3) is fixedly connected to the left and right ends of the left handlebar cover (1), a right elastic ring (4) is fixedly connected on the left and right ends of the right handlebar cover (2), wherein the connection component includes at least one strap loop (10), which is fixedly connected to the left end of the right handlebar cover (2), and a fastening belt (11) is fixedly connected with the right end of the left handlebar cover (1).

2. A handlebar cover for sports equipment according to claim 1, wherein a plurality of friction strips (9) is respectively provided on the outer end surfaces of the left handlebar cover (1) and the right handlebar cover (2).

3. A handlebar cover for sports equipment according to claim 1, wherein the left handlebar cover (1) and the right handlebar cover (2) are made of cotton material.

4. A handlebar cover for sports equipment according to claim 1, wherein the friction surfaces (5) are respectively provided inside the left handlebar cover (1) and the right handlebar cover (2).

5. A handlebar cover for sports equipment according to claim 1, wherein the left end of the right handlebar cover (2) and the right end of the left handlebar cover (1) each comprises a strap, and the two strap loops (10) are connected by the fastening belt (11).

6. A handlebar cover for sports equipment according to claim 1, wherein the fastening belt (11) is fixedly connected to the left end of the right handle cover (2) and the right end of the left handle cover (1).

* * * * *